US006602309B2

(12) United States Patent
Vizulis et al.

(10) Patent No.: US 6,602,309 B2
(45) Date of Patent: Aug. 5, 2003

(54) VENTED, GROOVED BACK, HEAT INDUCTION FOIL

(75) Inventors: Karlis Vizulis, Ada, MI (US); John W. Grover, Caledonia, MI (US)

(73) Assignee: Performance Systematix, Inc., Caladonia, MI (US)

( * ) Notice: Subject to any disclaimer, the term of this patent is extended or adjusted under 35 U.S.C. 154(b) by 0 days.

(21) Appl. No.: 09/865,656

(22) Filed: May 25, 2001

(65) Prior Publication Data

US 2002/0014057 A1 Feb. 7, 2002

Related U.S. Application Data

(60) Provisional application No. 60/208,076, filed on May 26, 2000.

(51) Int. Cl.[7] ..... B65D 53/00

(52) U.S. Cl. ..... 55/385.4; 55/487; 215/230; 215/232; 215/247; 215/250; 215/261; 428/344; 428/349; 428/416

(58) Field of Search ..... 55/385.1, 385.9, 55/487; 156/306.6, 280, 312; 215/230, 232, 247, 250, 261; 428/344, 349, 416

(56) References Cited

U.S. PATENT DOCUMENTS 1,467,706 A 9/1923 Collins
3,819,460 A * 6/1974 Dukess ..... 428/60.4
3,951,293 A 4/1976 Schultz
3,963,845 A * 6/1976 Dukess ..... 428/60.4
4,545,498 A 10/1985 Schmid
4,576,297 A * 3/1986 Larson ..... 215/250
4,579,240 A * 4/1986 Ou-Yang ..... 215/230
4,666,052 A * 5/1987 Ou-Yang ..... 215/230
4,733,786 A * 3/1988 Emslander ..... 215/230
4,756,437 A * 7/1988 Rossi-Mossuti ..... 215/230
4,789,074 A * 12/1988 Han ..... 215/230
4,818,577 A * 4/1989 Ou-Yang ..... 428/36.5
4,872,304 A * 10/1989 Thompson ..... 55/487
4,917,949 A * 4/1990 Yousif ..... 428/349
5,057,365 A * 10/1991 Finkelstein et al. ..... 428/344
5,482,591 A * 1/1996 Reo ..... 156/306.6
5,579,936 A * 12/1996 Costa et al. ..... 215/261
5,730,306 A * 3/1998 Costa et al. ..... 215/261

* cited by examiner

*Primary Examiner*—Duane Smith
*Assistant Examiner*—Minh-Chan T. Pham
(74) *Attorney, Agent, or Firm*—Kohn & Associates, PLLC

(57) ABSTRACT

There is provided a cap liner including a fluid impermeable layer for venting gas to and from the container and an adhering device for adhering the impermeable layer to a rim of a container and a channel extending therethrough for venting gas therethrough. Also provided by the present invention is a method of sealing an opening of a container by affixing a meltable layer of a sealing member to a container rim and venting the container through a vent patch, meltable layer, a foil layer, and a fluid impermeable layer having pathways thereon.

9 Claims, 1 Drawing Sheet

VENTED, GROOVED BACK, HEAT INDUCTION FOIL

CROSS-REFERENCE TO RELATED APPLICATIONS

This application claims the benefit of priority under 35 U.S.C. Section 119(e) of U.S. Provisional Patent Application No. 60/208,076, filed May 26, 2000, which is incorporated herein by reference.

BACKGROUND OF THE INVENTION

1. Technical Field

The present invention relates to fluid impermeable layer materials for use on containers. More specifically, the present invention relates to a fluid impermeable layer for containers which are used for storing liquids in manufacturing, laboratory or other storage situations.

2. Background Art

Containers are used for storing various types of liquids, for example, chlorine. Packaging conditions, changes in ambient temperature, changes in ambient pressure, as well as other factors can result in a pressure differential between the inside of the container the outside of the container. It is necessary to vent the container to avoid the explosion or implosion caused by this pressure differential. At the same time, it is necessary to perfect sufficient sealing about the container opening to insure safety from undesirable leakage and spilling from the container.

Various can and container top venting caps have been derived. For example, U.S. Pat. No. 30,585 to Paddock, issued Nov. 6, 1860, discloses a can including a lid having a valve guarded aperture communicating outwardly with an exhaust or vapor chamber which in turn communicates with a sealing cap. The U.S. Pat. No. 1,467,706 to Collins, issued Sep. 11, 1923, discloses a can top vent including a cap having a hole through its top wall located centrally thereof covered by a plate fixed to the outer surface 17 of the top wall. The plate includes a convolute corrugation formed therein, the outer end of which terminates at the edge of the plate which is preferably a disk shape while the other end terminates substantially in the center of the plate. The corrugation produces a convolute air channel with an inlet at its outer end which communicates with the atmosphere while the inner end of the corrugation overlies the hole in the cup so that the inner terminus of the channel communicates with the hole to complete the communication between the interior of the container and the atmosphere.

The U.S. Pat. No. 4,545,498 to Schmid, issued Oct. 8, 1985, discloses a container with a lid for effervescent products. The lid includes openings for the escape of gas. A layer, covering the opening is affixed to the surface 17 of the lid. A passage leads to the exterior and is connected with the openings disposed between the layer and the lid.

Problems exist with direct openings between the interior of the container, through a lid and passageway, to an exhaust. Tilting or inadvertent shaking of the container can results in spilling of the contents through the opening and passageway.

It has been found that hydrophobic membranes can be utilized to allow the passage of various gasses for increasing or decreasing the interior pressure of the container while perfecting a seal for containing a liquid. For example, the U.S. Pat. No. 3,951,293 to Schulz, issued Apr. 20, 1976, discloses a gas permeable liquid liner for containers of liquids or solids which emit or absorb gas. The liner includes a film of unsintered tetrafluoroethylene. The film is supported across an opening of the container by a perforated cap or a perforated sealing diaphragm which is disposed on either one or both sides of the film. Problems have arisen with the use of hydrophobic membrane layers in sealing caps. The hydrophobic membranes are most often quite fragile and are unable to perfect a seal between a cap and the lip of an opening of a container. The membrane can be damaged during the capping process so as to not perfect a hermetic seal.

Additionally, most container caps are shipped in bulk packages. During shipping, the caps take a random position within a bulk package. Depending upon the ratio of the size of the skirt of the cap to the diameter of the base of the cap, there remains the possibility that a corner of one cap can enter the skirt of another cap so as to contact and damage the membrane.

The present invention provides a solution to the aforementioned problems by providing a protective liner which can effectively perfect a hermetic seal yet is able to vent internal pressure differences, and additionally avoids damage during shipping.

SUMMARY OF THE INVENTION

In accordance with the present invention, there is provided a cap liner including a fluid impermeable layer for venting gas to and from the container and an adhering device for adhering the impermeable layer to a rim of a container and a channel extending therethrough for venting gas therethrough. Also provided by the present invention is a method of sealing an opening of a container by affixing a meltable layer of a sealing member to a container rim and venting the container through a vent patch, meltable layer, a foil layer, and a fluid impermeable layer having pathways thereon.

DESCRIPTION OF THE DRAWINGS

Other advantages of the present invention are readily appreciated as the same becomes better understood by reference to the following detailed description when considered in connection with the accompanying drawings wherein.

DETAILED DESCRIPTION OF THE INVENTION

Figure 1:
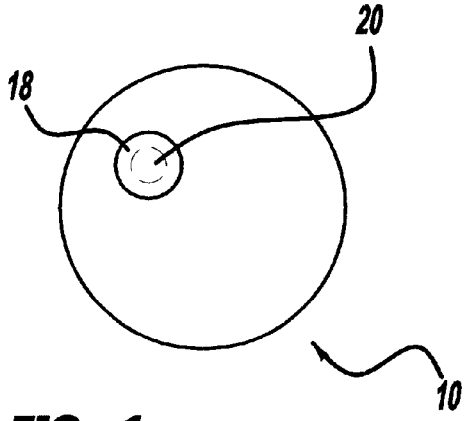
FIG. 1 is a plan view from the container side of the liner of the present invention.
Figure 2:
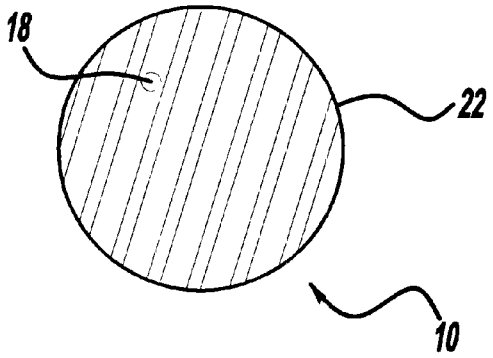
FIG. 2 is a plan view from the cap side of the liner of the present invention.

A venting liner constructed in accordance with the present invention is generally shown at 10 in the drawings. Generally, the venting liner 10 of the present invention is for a cap liner. More specifically, the liner 10 is for use in containers 13 that use push-pull type caps and flip top caps such as those found on sports bottles and household cleaners.

The opening is defined by a circumferential rim 24. A container 13 suitable for use with the present invention can take the form of existing containers 13 having a circumferential rim 24 defining openings therein.

The present invention provides a sealing means 16. The sealing means functions to perfect the seal of the liner on the container 13 by attaching to the rim 24 of the container 13. The sealing means 16 can be made of any meltable product known to those of skill in the art to be useful. In the preferred embodiment, the sealing means 16 can be made of, but is not limited to, polyethylene, polypropylene, PVC, PET, and combinations thereof. The entire liner 10 including the fluid impermeable layer 12, foil layer 14 and sealing means 16 are all fixedly connected to one another. This connection can be accomplished through various means such as gluing, ultrasonic bonding, heat infusion cycling, laminating, and other various types of adhesion known to those of skill in the art.

The liner 10 also includes a foil layer 14 which is fixedly attached to the sealing means 16. The foil layer 14 can be made of any foil material, or other material with properties similar to that of foil, which is known to those of skill in the art to be useful in this type of container 13. For example, the foil which is used in the prior art can be used in conjunction with the liner 10 of the present invention. In the preferred embodiment, the foil layer 14 is bonded and laminated to the sealing means 16.

The liner 10 includes a fluid impermeable layer, generally indicated at 12, which is laminated on top of the foil layer 14 for aiding in venting gas into and out of the container 13.

The present invention therefore provides a fluid impermeable layer 12 which vents gasses from a container 13 and thereby increases or decreases pressure within the container 13 wherein a seal is perfected between the sealing means 16 and the rim 24 and gas is therefore only able to escape via the vent hole 20 to the fluid impermeable layer 12. Gasses pass through a gas permeable membrane 18 which covers the vent hole 20.

The fluid impermeable layer 12 can be made of any material which is fluid impermeable. This can include, but is not limited to various types of foam, and other fluid impermeable materials known to those of skill in the art.

Figure 3:
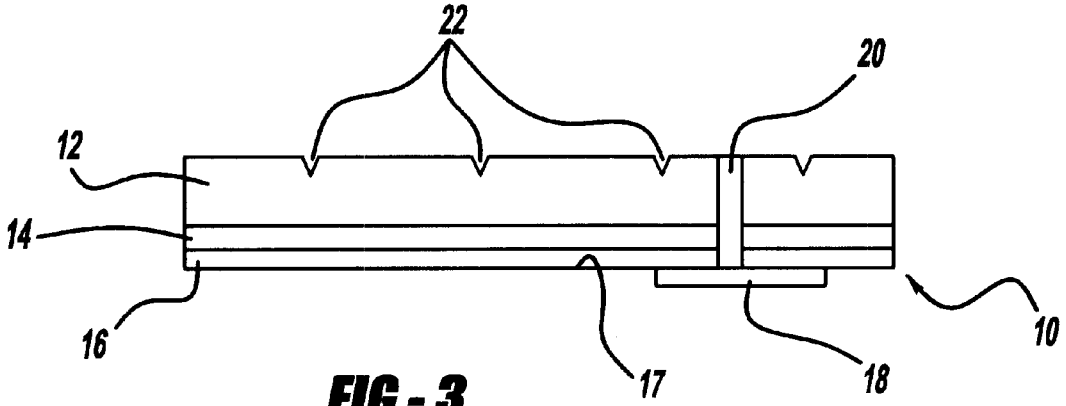
FIG. 3 is a cross-sectional view of the liner of the present invention.
Figure 4:
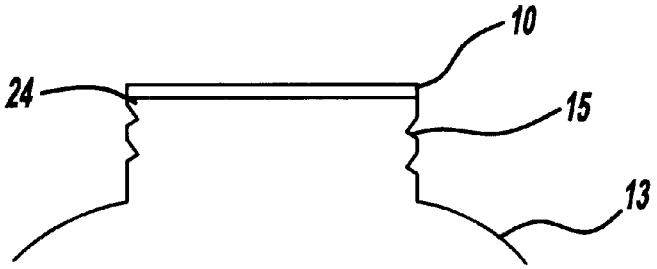
FIG. 4 is a cross-sectional view of the liner of the present invention secured upon a circumferential rim of a container.

Also included in the liner 10 is a vent patch 18. The vent patch 18 is fixedly attached to the surface 17 of the sealing/adhering means 16 opposite the foil layer 14. The vent patch 18 is a fluid impermeable, gas permeable matrix for venting gas to or from the interior of the container 13. The vent patch 18 covers a vent hole 20 or channel which extends through the sealing means 16, foil layer 14 and fluid impermeable layer 12. As depicted in FIGS. 1 and 3, the vent patch 18 only covers the vent hole 20. The vent patch 18 does not extend to the rim 24 of the container 13. Venting of gasses occurs throughout the vent hole 20. The hydrophobic membrane is positioned such that it covers the vent hole 20, thereby allowing venting to occur directly through the hydrophobic membrane 18 to the opening. If the vent hole 20 and fluid impermeable layer 12 are not aligned properly, proper venting cannot occur. In the preferred embodiment, the fluid impermeable layer 12 contains a pathway 22. The pathway 22 allows gas to travel to or from the interior of the container 13. The pathway 22 functions in the following manner. When the gas reaches the fluid impermeable layer 12 the gas travels to the pathway 22. The gas then travels through the pathway 22 to the exterior of the container 13, over the rim 24 to the outside of the container or it can occur in the reverse direction. In the preferred embodiment, the pathway 22 is a groove backed foam. The grooves are generally shown at 22 in the figures. The system allows the liner to vent gas without having to add a hole in the cap body.

In one embodiment of the present invention, the vent patch 18 includes an integral gas permeable hydrophobic portion. The gas permeable hydrophobic portion is also exposed to the inner compartment of the container 13 for performing the venting function.

The hydrophobic portion can consist of a polytetrafluorethylene membrane. Other types of gas permeable hydrophobic membranes with enhanced repelling properties can be utilized. The non-hydrophobic portion of the vent patch 18 can be made from various types of fibers or non-fibrous materials. The material can be woven or non-woven but other types of materials can also be used.

Alternatively, the vent patch can be made of a single material which is fluid impermeable and gas permeable. In this embodiment the entire vent patch 12 is made of a hydrophobic material which includes, but is not limited to, the materials disclosed above.

Additionally, as the layer of the entire vented liner are fixedly attached to one another, when the consumer desires to remove the liner, the entire assembly is removed at the same time.

The vented liner 10 of the present invention is formed by affixing a meltable layer of a sealing member 16 to a container rim 24. Venting of the container 13 occurs through a vent patch 18, a vent hole 20 extending through the sealing means 16, the foil layer 14, and the fluid impermeable layer 12 having pathways 22. The fluid impermeable layer 12 having pathways 22, foil layer 14, and sealing means 16 are adhered together using methods known to those of skill in the art. These can include gluing these layers together, ultrasonic bonding the layers, heat integration cycling of the layers, laminating, or other types of adhesive methods known to those of skill in the art. The liner 10 is then applied to the container 13 utilizing the sealing means 16 to the rim 24 of the container 13.

When adhering and affixing as set forth above, it is best to accomplish this by creating the liner of the present invention and then affixing this to the rim 24 of the container 13. Alternatively, the liner is created by aligning the layers over the container rim 24, then heat sealing the layers together both to one another and to the sealing means 16 to the container rim 24 simultaneously.

Throughout this application, various publications, including United States patents, are referenced by author and year and patents by number. Full citations for the publications are listed below. The disclosure of these publications and patents in their entireties are hereby incorporated by reference into this application in order to more fully describe the state of the art to which this invention pertains.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, the invention can be practiced otherwise than as specifically described.

What is claimed is:

1. A container liner comprising:

a fluid impermeable layer for venting gas to and from the container, adhering means for adhering said impermeable layer to a rim of a container, a single vent hole extending therethrough for venting gas therethrough, and a vent patch covering said vent hole and not extending to the rim of the container and preventing fluid from entering said vent hole.

2. The liner according to claim 1, wherein said fluid impermeable layer includes a pathway for creating venting spaces between the container cap and the rim.

3. The liner according to claim 1, including hydrophobic means disposed on said impermeable layer and over said single vent hole for preventing fluid from entering said vent hole.

4. The liner according to claim 1, wherein said liner includes a foil layer disposed between said fluid impermeable layer and said adhering means.

5. The liner according to claim 1, wherein said vent patch includes a hydrophobic portion.

6. A method of sealing an opening of a container by;

affixing a meltable layer of a sealing member to a container rim and venting the container through a single vent hole extending through a sealing means, the single vent hole covered by a vent patch covering only the vent hole, foil layer, and fluid impermeable layer and then over pathways to the rim of the container for exhaust.

7. The method according to claim 6, further including the step of adhering together the sealing means and fluid impermeable layer then affixing the meltable layer to the rim of the container.

8. The method according to claim 7, wherein said adhering and affixing steps are accomplished by creating the liner and affixing the liner to the container rim.

9. The method according to claim 7, wherein adhering step includes adhering a vent patch onto said meltable layer.

* * * * *